US006875339B2

(12) United States Patent
Rangarajan et al.

(10) Patent No.: US 6,875,339 B2
(45) Date of Patent: Apr. 5, 2005

(54) OCTANE IMPROVEMENT OF A HYDROCARBON STREAM

(75) Inventors: Priya Rangarajan, Ponca City, OK (US); Steven R. McDonald, Ponca City, OK (US); Joe D. Allison, Ponca City, OK (US); Keith H. Lawson, Ponca City, OK (US); Oluwaseyi A. Odueyungbo, Ponca City, OK (US); Doug S. Jack, Ponca City, OK (US); Rafael L. Espinoza, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/795,895

(22) Filed: Mar. 8, 2004

(65) Prior Publication Data

US 2004/0236164 A1 Nov. 25, 2004

Related U.S. Application Data

(60) Provisional application No. 60/452,842, filed on Mar. 7, 2003.

(51) Int. Cl.[7] ..... C10G 54/00; C10G 59/02

(52) U.S. Cl. ..... 208/62; 208/63; 208/64; 208/67

(58) Field of Search ..... 208/62, 63, 64; 585/322, 333, 324

(56) References Cited

U.S. PATENT DOCUMENTS

| | | | | |
|---|---|---|---|---|
| 4,451,572 | A | 5/1984 | Cody | 502/62 |
| 4,645,586 | A | 2/1987 | Buss | 208/65 |
| 4,830,729 | A | 5/1989 | Dessau et al. | 208/89 |
| 5,013,423 | A | 5/1991 | Chen et al. | 208/64 |
| 5,037,529 | A | 8/1991 | Dessau et al. | 208/64 |
| 5,494,571 | A | 2/1996 | Umansky et al. | 208/138 |
| 5,609,751 | A | 3/1997 | Wall | 208/133 |
| 5,643,441 | A | 7/1997 | Timken et al. | 208/89 |
| 5,645,812 | A | 7/1997 | Nakagawa | 423/706 |
| 5,895,828 | A | 4/1999 | Yao et al. | 585/418 |
| 5,922,922 | A | 7/1999 | Harris et al. | 585/323 |
| 5,958,217 | A | 9/1999 | Nacamuli et al. | 208/65 |
| 6,177,601 | B1 | 1/2001 | Bogdan et al. | 585/419 |
| 6,190,534 | B1 | 2/2001 | Bogdan | 208/65 |

OTHER PUBLICATIONS

Sie Hrishna (Applied Catalysis A: General 1999, 186, p. 55).

J.S. Beck, "*New Developments in Shape–Selective Catalysis at ExxonMobil: Exploring Principles Behind the Design of Zeolite Catalysts for Selective Production of Aromatic Compounds*", 2002 AIChE Spring Meeting, Mar. 10–14, 2002.

Fucht, et al, "*n–Octane reforming over modified catalysts II. The Role of Au, Ir and Pd*", Applied Catalysis A: General 2002, pp. 151–157.

Beck, et al., "*Aromatics Alkylation–Towards Cleaner, More Selective Processes*", ExxonMobil Research and Engineering 2002, pp. 1–28.

*Primary Examiner*—Thuan D Dang
(74) *Attorney, Agent, or Firm*—Conley Rose P.C.

(57) ABSTRACT

The invention relates to methods for improving the octane number of a synthetic naphtha stream and optionally for producing olefins and/or solvents. In one embodiment, the method comprises aromatizing at least a portion of a synthetic naphtha stream to produce an aromatized hydrocarbon stream; and isomerizing at least a portion of the aromatized hydrocarbon stream to produce an isomerized aromatized hydrocarbon stream having a higher octane rating than the synthetic naphtha stream. Alternatively, the method comprises providing at least three synthetic naphtha cuts comprising a $C_4$–$C_5$ stream; a $C_6$–$C_8$ stream and a $C_9$–$C_{11}$ stream; aromatizing some of the $C_6$–$C_8$ stream to form an aromatized hydrocarbon stream with a higher octane number; steam cracking some of the $C_6$–$C_8$ stream and optionally the $C_9$–$C_{11}$ stream to form olefins; and selling some portions of $C_9$–$C_{11}$ stream as solvents. In preferred embodiments, the synthetic naphtha is derived from Fischer-Tropsch synthesis.

31 Claims, 3 Drawing Sheets

OCTANE IMPROVEMENT OF A HYDROCARBON STREAM

CROSS-REFERENCE TO RELATED APPLICATIONS

This non-provisional application claims the benefit of U.S. Provisional Application No. 60/452,842, filed on Mar. 7, 2003, which is hereby incorporated by reference in its entirety.

STATEMENT REGARDING FEDERALLY SPONSORED RESEARCH OR DEVELOPMENT

Not applicable.

BACKGROUND OF THE INVENTION

1. Field of the Invention

This invention relates to the field of octane improvement of a hydrocarbon stream and more specifically to the octane improvement of naphtha produced by Fischer-Tropsch synthesis.

2. Background of the Invention

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Wells that provide natural gas are often remote from locations with a demand for the consumption of the natural gas.

Thus, natural gas is conventionally transported large distances from the wellhead to commercial destinations in pipelines. However, the transportation over large distances may require refrigerated, pressurized vessels. This transportation presents technological challenges due in part to the large volume occupied by a gas. Because the volume of a gas is so much greater than the volume of a liquid containing the same number of gas molecules, the process of transporting natural gas typically includes chilling and/or pressurizing the natural gas in order to liquefy it. However, this contributes to the final cost of the natural gas.

Further, naturally occurring sources of crude oil used for liquid fuels such as gasoline and middle distillates have been decreasing, and supplies are not expected to meet demand in the coming years. Middle distillates typically include heating oil, jet fuel, diesel fuel, and kerosene. Fuels that are liquid under standard atmospheric conditions have the advantage that, in addition to their value, they can be transported more easily in a pipeline or in large vessels than natural gas, since they do not require the energy, equipment, and expense required for liquefaction.

Thus, for all of the above-described reasons, there has been interest in developing technologies for converting natural gas to more readily transportable liquid fuels, i.e. to fuels that are liquid at standard temperatures and pressures. One method for converting natural gas to liquid fuels involves two sequential chemical transformations. In the first transformation, natural gas or methane, the major chemical component of natural gas, is reacted with oxygen and/or steam to form synthesis gas, which is a combination of carbon monoxide and hydrogen. In the second transformation, which is known as Fischer-Tropsch synthesis, carbon monoxide is reacted with hydrogen to form organic molecules containing mainly carbon and hydrogen. Those organic molecules containing carbon and hydrogen are known as hydrocarbons. In addition, other organic molecules containing oxygen in addition to carbon and hydrogen, which are known as oxygenates, can also be formed during the Fischer-Tropsch synthesis. Hydrocarbons comprising carbons having no ring formation are known as aliphatic hydrocarbons and are particularly desirable as the basis of synthetic diesel fuel.

Typically, the Fischer-Tropsch product stream contains hydrocarbons having a range of numbers of carbon atoms, and thus has a range of molecular weights. Therefore, the Fischer-Tropsch products produced by conversion of synthesis gas commonly contain a range of hydrocarbons including gases, liquids and waxes. Depending on the molecular weight product distribution, different Fischer-Tropsch product mixtures are ideally suited to different uses. For example, Fischer-Tropsch product mixtures containing liquids may be processed to yield naphtha, diesel, and jet fuel, as well as heavier middle distillates. Hydrocarbon waxes may be subjected to an additional hydroprocessing step for conversion to a liquid and/or a gaseous hydrocarbon. Thus, in the production of a Fischer-Tropsch product stream for processing to a fuel, it is desirable to maximize the production of high value liquid hydrocarbons, such as hydrocarbons with at least 5 carbon atoms per hydrocarbon molecule ($C_{5+}$ hydrocarbons).

The Fischer-Tropsch process is commonly facilitated by a catalyst. Catalysts desirably have the function of increasing the rate of a reaction without being consumed by the reaction. A feed containing carbon monoxide and hydrogen is typically contacted with a catalyst in a reaction zone that may include one or more reactors.

The catalyst may be contacted with synthesis gas in a variety of reaction zones that may include one or more reactors, either placed in series, in parallel or both. Common reactors include packed bed (also termed fixed bed) reactors and slurry bed reactors. Originally, the Fischer-Tropsch synthesis was carried out in packed bed reactors. These reactors have several drawbacks, such as temperature control, that can be overcome by gas-agitated slurry reactors or slurry bubble column reactors. Gas-agitated multiphase reactors comprising catalytic particles sometimes called "slurry reactors," "ebullating bed reactors," "slurry bed reactors" or "slurry bubble column reactors," operate by suspending catalytic particles in liquid and feeding gas reactants into the bottom of the reactor through a gas distributor, which produces small gas bubbles. As the gas bubbles rise through the reactor, the reactants are absorbed into the liquid and diffuse to the catalyst where, depending on the catalyst system, they are typically converted to gaseous and liquid products. The gaseous products formed enter the gas bubbles and are collected at the top of the reactor. Liquid products are recovered from the suspending liquid by using different techniques like filtration, settling, hydrocyclones, magnetic techniques, etc. Some of the principal advantages of gas-agitated multiphase reactors or slurry bubble column reactors (SBCRs) for the exothermic Fischer-Tropsch synthesis are the very high heat transfer rates, and the ability to remove and add catalyst online. Sie and Krishna (Applied Catalysis A: General 1999, 186, p. 55), incorporated herein by reference in its entirety, give a history of the development of various Fischer-Tropsch reactors.

The naphtha produced typically is comprised mainly of $C_5$ through $C_{11}$ linear alkanes. Such material has low octane value and typically requires processing to upgrade for use in gasoline formulations. Therefore, the naphtha is typically used as a feedstock for a steam cracker. In the steam cracker, the light ends of the naphtha are broken down into olefins, such as ethylene, propylene and butenes. Drawbacks include low yields for heavier fractions. In addition, drawbacks include the production of coke.

Consequently, there is a need for improving the octane number of a Fischer-Tropsch naphtha. A further need exists for an improved process for increasing the octane number of a Fischer-Tropsch naphtha.

BRIEF SUMMARY OF SOME OF THE PREFERRED EMBODIMENTS

These and other needs in the art are addressed in one embodiment by a method for improving the octane number of a synthetic naphtha stream, wherein the synthetic naphtha stream is preferably from a hydrocarbon synthesis process. The method for improving the octane number of a synthetic naphtha stream, comprises providing a hydrocarbon feedstream comprising primarily $C_4$–$C_8$ acyclic hydrocarbons, wherein the hydrocarbon feedstream has an octane number and is derived from a hydrocarbon synthesis process; reacting the hydrocarbon feedstream under aromatization promoting conditions so as to convert at least some of the acyclic hydrocarbons to aromatic hydrocarbons and generate a cyclized hydrocarbon stream, wherein the cyclized hydrocarbon stream includes said aromatic hydrocarbons and unconverted acyclic hydrocarbons; and reacting the cyclized hydrocarbon stream under isomerization promoting conditions so as to convert at least some of the unconverted acyclic hydrocarbons to branched hydrocarbons and generate a cyclized, isomerized hydrocarbon stream, wherein the cyclized, isomerized hydrocarbon stream includes aromatic hydrocarbons and branched hydrocarbons, and has an octane number greater than the octane number of the hydrocarbon feedstream.

Additional embodiments include a method for improving the octane number of a synthetic naphtha stream, comprising: providing a hydrocarbon feedstream comprising $C_4$–$C_8$ acyclic hydrocarbons, wherein the hydrocarbon feedstream has an octane number and is derived from a hydrocarbon synthesis process; reacting the hydrocarbon feedstream under isomerization promoting conditions so as to convert at least some of the acyclic hydrocarbons to branched acyclic hydrocarbons and generate an isomerized hydrocarbon stream, wherein the isomerized hydrocarbon stream includes branched acyclic hydrocarbons and unconverted acyclic hydrocarbons; and reacting the isomerized hydrocarbon stream under aromatization promoting conditions so as to convert at least some of the unconverted acyclic and isomerized acyclic hydrocarbons to aromatic hydrocarbons and generate a cyclized, isomerized hydrocarbon stream, wherein the cyclized, isomerized hydrocarbon stream includes aromatic hydrocarbons and branched acyclic hydrocarbons, and has an octane number greater than the octane number of the hydrocarbon feedstream.

Other embodiments include a method for improving the octane number of a hydrocarbon stream, wherein the hydrocarbon stream is from a hydrocarbon synthesis process, and wherein the hydrocarbon stream comprises mainly $C_6$–$C_8$ hydrocarbons. The method comprises reacting at least a portion of the hydrocarbon stream with hydrogen over an aromatization catalyst comprising a micro porous molecular sieve support under conversion promoting conditions so as to produce a hydrocarbon product. In addition, the method comprises reacting at least a portion of the hydrocarbon product with hydrogen over a non-acidic aromatization catalyst to produce an improved hydrocarbon stream, wherein the improved hydrocarbon stream comprises at least one aromatic compound selected from the group consisting of benzene, toluene, ethyl benzene, ethyl toluene, and xylenes.

Additional embodiments include a method for producing olefins, solvents, and light aromatic hydrocarbons from a synthetic naphtha stream. The method comprises providing three synthetic hydrocarbon streams, including a light hydrocarbon stream comprising primarily $C_4$–$C_5$ acyclic hydrocarbons, an intermediate hydrocarbon stream comprising primarily $C_6$–$C_8$ acyclic hydrocarbons, and a heavy fraction comprising primarily $C_9$–$C_{11}$ acyclic hydrocarbons. The method further comprises passing the light hydrocarbon stream and optionally, at least a portion of the heavy hydrocarbon stream to a steam cracker. Moreover, the method comprises cracking in the presence of steam at least a portion of the light hydrocarbon stream and optionally, at least a portion of the heavy hydrocarbon stream under suitable cracking conditions in said steam cracker so as to convert at least a portion of the acyclic hydrocarbons to olefins and to produce a steam cracker effluent, wherein the stream cracker effluent comprises said olefins. In addition, the method comprises reacting the intermediate hydrocarbon fraction under aromatization promoting conditions so as to convert at least some of the acyclic hydrocarbons to aromatic hydrocarbons and generate a cyclized hydrocarbon stream, wherein the cyclized hydrocarbon stream includes said aromatic hydrocarbons and unconverted acyclic hydrocarbons, and has an octane number higher than that of the intermediate hydrocarbon fraction, wherein the method further includes one hydrotreating step selected from the group consisting of: hydrotreating the hydrocarbon feedstream with hydrogen prior to the passing step; hydrotreating the light hydrocarbon stream and optionally at least a portion of the heavy hydrocarbon stream with hydrogen prior to the cracking step; and combination thereof.

It will therefore be seen that a technical advantage of the present invention includes a process for upgrading the octane rating of a Fischer-Tropsch naphtha, which allows the Fischer-Tropsch naphtha to be used as a fuel without significant further processing. For instance, Fischer-Tropsch naphtha typically requires significant processing to be used as a fuel.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
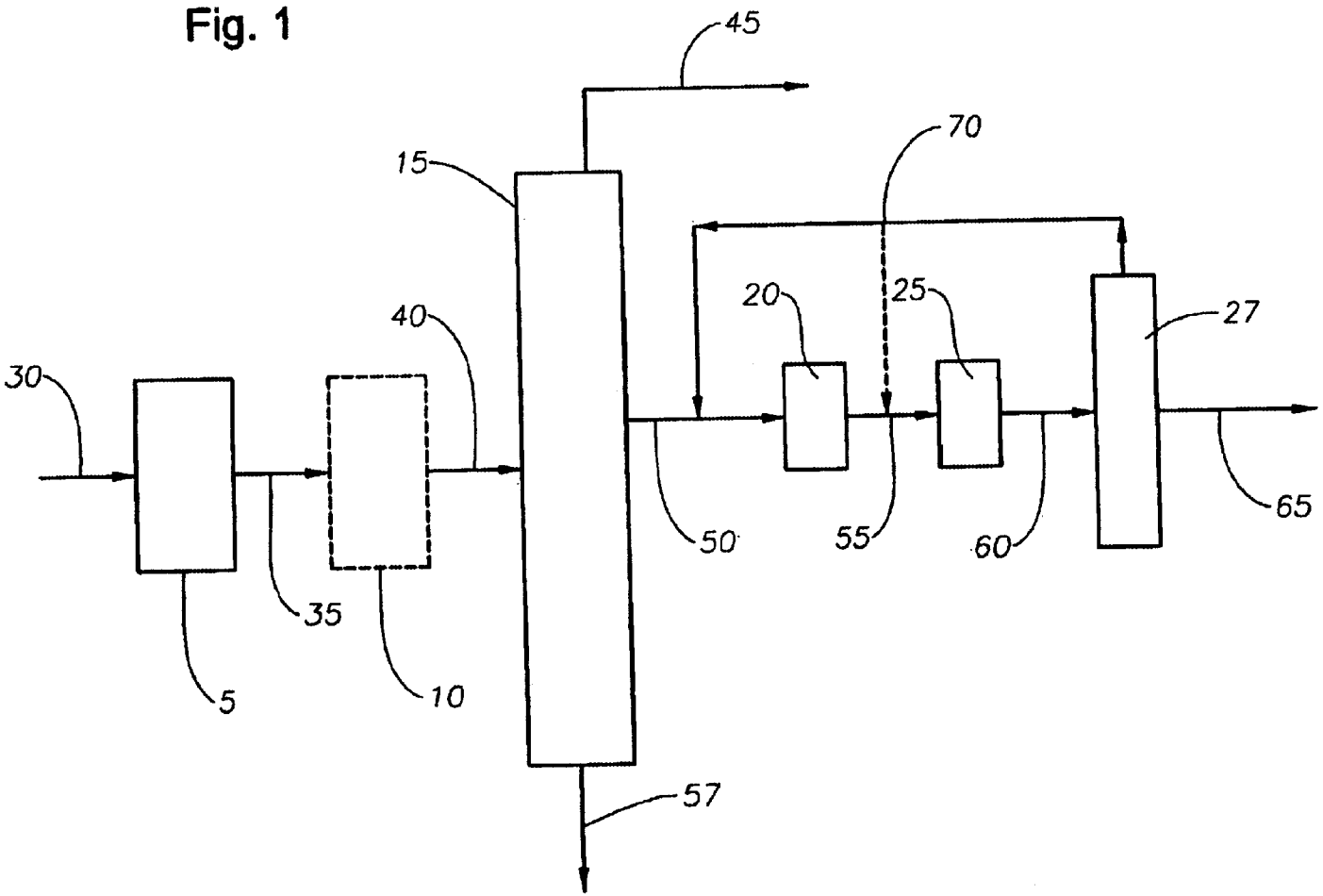
FIG. 1 illustrates a method for improving the octane rating of a hydrocarbon comprising a hydrocarbon synthesis reactor, an optional hydrotreater, a fractionator, an aromatization zone, an isomerization zone, and a naphtha fractionator.

As used herein, a "$C_n$ hydrocarbon" represents a hydrocarbon with "n" carbon atoms, and "$C_n$–$C_m$ hydrocarbons" represents hydrocarbons having between "n" and "m" carbon atoms.

As used herein, a "portion of a stream" represents a split-stream of said stream, such that the compositions of the portion and the stream are substantially the same.

As used herein, a "fraction of a stream" results from the separation by distillation of said stream, such that the compositions of the fraction and the stream are substantially different. As used herein, the boiling range distribution and specific boiling points for a hydrocarbon stream or fraction within the naphtha boiling range are generally determined by the American Society for Testing and Materials (ASTM) D-86 method "Standard Test Method for Distillation of Petroleum Products at Atmospheric Pressure," unless otherwise stated.

It should be understood by those of ordinary skill in the art that producing a fraction with hydrocarbons comprising definite carbon number cutoffs, e.g., $C_4$–$C_8$ or $C_4$–$C_{11}$, may typically be very difficult and expensive, although not impossible. The reality, especially in industrial settings, is that a distillation process targeting a cutoff of a specified carbon number or temperature may contain a small amount of material above or below the target that becomes entrained into the fraction for various reasons. For example, no two fractions of "naphtha" are exactly the same, however, it still is designated and sold as "naphtha." It is therefore intended that these explicitly specified fractions may contain a small amount of other material. The amount outside the targeted range will generally be determined by how much time and expense the user is willing to expend and/or by the limitations of the type of fractionation technique or equipment available.

An embodiment of the present invention includes a method for improving the octane number of a hydrocarbon stream, wherein the hydrocarbon stream is from a hydrocarbon synthesis process, and wherein the hydrocarbon stream comprises mainly $C_6$–$C_8$ hydrocarbons. The method comprises isomerizing at least a portion of the hydrocarbon stream to produce a partially-branched, isomerized alkene, wherein the hydrocarbon stream is reacted over a catalyst comprising a micro porous molecular sieve support in the presence of hydrogen. In addition, the method comprises the aromatization of at least a portion of the partially-branched, isomerized alkene to produce an improved hydrocarbon stream, wherein the at least a portion of the partially-branched, isomerized alkene is passed over an acidic catalyst in the presence of hydrogen, and wherein the improved hydrocarbon stream comprises at least one aromatic compound selected from the group consisting of benzene, toluene, ethyl benzene, ethyl toluene, and xylenes. A micro porous material is characterized by an average pore size of less than about 10 Angstroms (i.e., 1 nanometer).

An additional embodiment of the present invention also includes a method for improving the octane number of a hydrocarbon stream, wherein the hydrocarbon stream is from a hydrocarbon synthesis process, and wherein the hydrocarbon stream comprises mainly $C_6$–$C_8$ hydrocarbons. The method comprises reacting at least a portion of the hydrocarbon stream over reforming catalysts at elevated temperatures in the presence of hydrogen to produce a reformate stream. In addition, the method comprises isomerizing at least a portion of the reformate stream to produce an improved hydrocarbon stream, wherein at least a portion of the reformate stream is passed over a catalyst comprising a micro porous molecular sieve support in the presence of hydrogen, and wherein the improved hydrocarbon stream comprises at least one aromatic compound selected from the group consisting of benzene, toluene, ethyl benzene, ethyl toluene, and xylene.

FIG. 1 illustrates a process for upgrading a hydrocarbon by increasing its octane rating. FIG. 1 represents a novel approach for the upgrading of synthetic naphtha (such as desired from Fischer-Tropsch synthesis), which encompasses the use of two technologies employed in series: a cyclization of higher hydrocarbons (primarily of $C_6$–$C_8$ paraffins) and the isomerization of lower hydrocarbons (primarily of $C_4$–$C_5$ paraffins).

The process of FIG. 1 comprises a hydrocarbon synthesis reactor 5, an optional hydrotreater 10 (shown in dotted line), a fractionator 15, an aromatization zone 20, an isomerization zone 25, and a naphtha fractionator 27. Hydrocarbon synthesis reactor 5 comprises any reactor in which hydrocarbons are produced from syngas by Fischer-Tropsch synthesis, alcohol synthesis, and any other suitable synthesis. Hydrocarbon synthesis reactor 5 preferably comprises a Fischer-Tropsch reactor.

It is to be understood that aromatization zone 20 and isomerization zone 25 can occur in any order, with isomerization zone 25 being downstream of aromatization zone 20, with aromatization zone 20 being downstream of isomerization zone 25, or simultaneously. The embodiment as illustrated in FIG. 1 is the preferred embodiment with isomerization zone 25 being downstream of aromatization zone 20. It is to be further understood that aromatization zone 20 and isomerization zone 25 can be in the same or different reactor vessels. For instance, in an embodiment wherein aromatization zone 20 and isomerization zone 25 occur in the same reactor vessel, such that the aromatization step and isomerization step can occur in sequential reaction zones in any order, preferably with the isomerization step following the aromatization step. In other embodiments, the aromatization step in zone 20 and isomerization step in zone 25 can occur in sequence in more than one reactor vessel. In further alternative embodiments, the aromatization step in zone 20 is optional.

The reactors comprising aromatization zone 20 and/or isomerization zone 25 can include any type of reactor bed configuration or combinations of types of reactor beds. Preferably, the reactor bed configuration is selected from among a fixed bed configuration, fluidized bed, slurry bubble column or ebullating bed reactors, among others. Aromatization zone 20 and/or isomerization zone 25 can be run in batch mode, but preferably are operated in continuous or semi-continuous mode. More preferably, the reactor bed configuration for aromatization zone 20 comprises a fixed bed or fluidized bed configuration; and the reactor bed configuration for isomerization zone 25 comprises a fixed bed configuration.

As illustrated in FIG. 1, a syngas 30 is fed to hydrocarbon synthesis reactor 5. Syngas feed 30 comprises hydrogen and carbon monoxide. It is preferred that the molar ratio of hydrogen to carbon monoxide in syngas feed 30 be greater than 0.5:1 (e.g., from about 0.67 to about 2.5). Preferably, when cobalt, nickel, iron, and/or ruthenium catalysts are used, syngas feed 30 comprises hydrogen and carbon monoxide in a molar ratio of about 1.4:1 to about 2.3:1. Syngas feed 30 may also comprise carbon dioxide. Moreover, syngas feed 30 preferably comprises a very low concentration of compounds or elements that have a deleterious effect on the catalyst, such as poisons. For example, syngas feed 30 may be pretreated to ensure that it contains low concentrations of sulfur or nitrogen compounds such as hydrogen sulfide, hydrogen cyanide, ammonia and carbonyl sulfides. Syngas feed 30 is contacted with the catalyst in a reaction zone. Mechanical arrangements of conventional design may be employed as the reaction zone including, for example, fixed bed, fluidized bed, slurry bubble column or ebullating bed reactors, among others. Accordingly, the preferred size and physical form of the catalyst particles may vary depending on the reactor in which they are to be used. In preferred embodiments, hydrocarbon synthesis reactor 5 comprises a slurry bubble column reactor loaded with catalyst particles of fresh size between about 20 microns and 200 microns, wherein said catalyst particles comprise cobalt as catalytically active metal and optionally promoters. In alternative embodiments, hydrocarbon synthesis reactor 5 comprises a fixed bed reactor loaded with catalyst particles of a fresh size greater than about 250 microns, wherein said catalyst particles comprise cobalt or iron as catalytically active metal and optionally promoters.

Hydrocarbon synthesis reactor 5 is typically run in a continuous mode. In this mode, the gas hourly space velocity through the reaction zone typically may range from about 50 to about 10,000 $hr^{-1}$, preferably from about 300 $hr^{-1}$ to about 2,000 $hr^{-1}$. The gas hourly space velocity is defined as the volume of reactants per time per reaction zone volume. The volume of reactant gases is preferably at but not limited to standard conditions of pressure (101 kPa) and temperature (0° C.). The reaction zone volume is defined by the portion of the reaction vessel volume in which the reaction takes place and that is occupied by a gaseous phase comprising reactants, products and/or inerts; a liquid phase comprising liquid/wax products and/or other liquids; and a solid phase comprising catalyst. The reaction zone temperature is typically in the range from about 160° C. to about 300° C. Preferably, the reaction zone is operated at conversion promoting conditions at temperatures from about 190° C. to about 260° C., more preferably from about 205° C. to about 230° C. The reaction zone pressure is typically in the range of about 80 psia (552 kPa) to about 1,000 psia (6,895 kPa), more preferably from 80 psia (552 kPa) to about 800 psia (5,515 kPa), and still more preferably from about 140 psia (965 kPa) to about 750 psia (5,170 kPa). Most preferably, the reaction zone pressure is from about 250 psia (1,720 kPa) to about 650 psia (4,480 kPa).

Hydrocarbon synthesis reactor 5 produces at least one hydrocarbon synthesis product 35, which primarily comprises hydrocarbons. Hydrocarbon synthesis product 35 may also comprise oxygen-containing hydrocarbons, also called oxygenates, such as alcohols, aldehydes, and the like. Hydrocarbon synthesis product 35 may also comprise unsaturated hydrocarbons, also called olefins. Hydrocarbon synthesis product 35 preferably primarily comprises hydrocarbons with 5 or more carbon atoms. Hydrocarbon synthesis product 35 preferably contains at least 70% by weight of $C_{5+}$ linear paraffins, more preferably at least 75% by weight of $C_{5+}$ linear paraffins, and most preferably at least 85% by weight of $C_{5+}$ linear paraffins. Hydrocarbon synthesis product 35 can contain up to 10% by weight of olefins. Hydrocarbon synthesis product 35 may also comprise heteroatomic compounds such as sulfur-containing compounds (e.g., sulfides, thiophenes, benzothiophenes, and the like); nitrogen-containing compounds (e.g., amines, ammonia, and the like); and oxygenated hydrocarbons also called oxygenates (e.g., alcohols, aldehydes, esters, aldols, ketones, and the like). Hydrocarbon synthesis product 35 can contain up to 10% by weight of oxygenates, but more typically between about 0.5% and about 5% by weight of oxygenates. Hydrocarbon synthesis product 35 also typically contains less than 0.01% by weight of sulfur-containing and nitrogen-containing compounds, preferably less than 10 ppm S and less than 20 ppm N.

Hydrocarbon synthesis product 35 may be fed to optional hydrotreater 10 for hydrotreatment. As used herein, to "hydrotreat" generally refers to the saturation of unsaturated carbon-carbon bonds and removal of heteroatoms (e.g., oxygen, sulfur, nitrogen, and the like) from heteroatomic compounds. To "hydrotreat" means to treat a hydrocarbon stream with hydrogen without making any substantial change to the carbon backbone of the molecules in the hydrocarbon stream. For example, hydrotreating a hydrocarbon stream comprising predominantly an alkene with an unsaturated C=C bond in the alpha position (first carbon-carbon bond in the carbon chain) yields a hydrocarbon stream comprising predominantly the corresponding alkane (e.g., for hydrotreating of alpha-pentene, the ensuing reaction follows: $H_2C{=}CH{-}CH_2{-}CH_2{-}CH_3+H_2 \rightarrow CH_3{-}CH_2{-}CH_2{-}CH_2{-}CH_3$). The hydrotreatment saturates at least a portion of the olefins or substantially all of the olefins in hydrocarbon synthesis product 35. The hydrotreatment may substantially convert all of the oxygenates to paraffins or may allow a substantial amount of the oxygenates to remain unconverted. The hydrotreatment can take place over hydrotreating catalysts. Depending on the selection of the catalyst and temperature, the hydrotreatment in hydrotreater 10 may have a mild severity in such a manner that olefins and oxygenates are all substantially converted or have an ultra-low severity in such as manner that some oxygenates remain in hydrotreated product. The hydrotreating catalyst used in hydrotreater 10 can be selected from Groups 6, 8, 9, and 10 of the Periodic Table. Without limitation, examples of such metals include molybdenum, tungsten, nickel, palladium, platinum, ruthenium, iron, and cobalt. Catalysts comprising nickel, palladium, platinum, tungsten, molybdenum, ruthenium, and combinations thereof are typically highly active, and catalysts comprising iron and/or cobalt are typically less active catalysts. It should be understood that hydrotreatment catalysts can comprise promoters and can be conducted with or without support, although preferably supported. Preferably, hydrotreater 10 comprises a nickel catalyst.

For the highly active catalysts, the hydrotreatment is preferably conducted at temperatures from about 80° C. to about 250° C., more preferably from about 80° C. to about 235° C., and most preferably from about 80° C. to about 220° C. For ultra-low severity hydrotreatment with such highly active catalysts, the temperature can be from about 80° C. to about 180° C., more preferably from about 80° C. to about 160° C., and most preferably from about 80° C. to about 150° C. For the less active catalysts (iron and/or cobalt), the hydrotreatment is preferably conducted at temperatures from about 180° C. to about 350° C. For ultra-low severity hydrotreatment with such less active catalysts, the temperature can be from about 180° C. to about 300° C. Other operating parameters of hydrotreater 10 may be varied by one of ordinary skill in the art to affect the desired hydrotreatment. For instance, the hydrogen partial pressure is preferably between about 1,000 kPa and about 20,000 kPa, and more preferably between about 2,000 kPa and about 10,000 kPa. For ultra-low severity hydrotreatment, the hydrogen partial pressure is preferably between about 700 kPa and about 6,000 kPa, and more preferably between about 2,000 kPa and about 3,500 kPa. Moreover, the liquid hourly space velocity is preferably between about 1 $hr^{-1}$ and about 10 $hr^{-1}$, more preferably between about 0.5 $hr^{-1}$ and about 6 $hr^{-1}$, and most preferably between about 1 $hr^{-1}$ and about 5 $hr^{-1}$.

Fractionator feedstream 40 comprises non-hydrotreated or hydrotreated hydrocarbon synthesis product 35. Fractionator feedstream 40 is fed to fractionator 15 where it is separated into distillation cuts, which comprise a light distillate 45; at least one middle distillate including a hydrocarbon stream 50; and a heavy distillate 57. Light distillate 45 comprises hydrocarbons having primarily 4or less carbons ($C_4$-hydrocarbons). Hydrocarbon stream 50 can comprise $C_5$–$C_{25}$ hydrocarbons. Preferably, hydrocarbon stream 50 comprises $C_4$–$C_{11}$ or $C_5$–$C_{11}$ hydrocarbons. The $C_4$–$C_{11}$ or $C_5$–$C_{11}$ hydrocarbons comprise mostly acyclic hydrocarbons and are typically referred to as Fischer-Tropsch naphtha. Alternatively, hydrocarbon stream 50 comprises $C_4$–$C_8$ or $C_5$–$C_8$ hydrocarbons. As referred to herein, acyclic hydrocarbons have a carbon structure without a ring. Some of these acyclic hydrocarbons may be linear hydrocarbons (such as normal paraffins) or branched hydrocarbons (such as isoparaffins). Hydrocarbon stream 50 preferably has at least 80 wt % paraffins. As referred to herein, linear hydrocarbons have no substituent branches stemming from the main hydrocarbon chain, whereas branched hydrocarbons have at least one substituent branch stemming from the main hydrocarbon chain. Paraffins are saturated hydrocarbons having no unsaturated C—C bonds. Normal or linear paraffins represent paraffins with no branching, whereas branched paraffins represent isomers of paraffins with some branching (also called isoparaffins). It is to be understood that hydrocarbon stream 50 comprising a Fischer-Tropsch naphtha or a cut of a Fischer-Tropsch naphtha is substantially different from a typical refinery naphtha stream such as from a conventional petroleum refinery. For instance, hydrocarbon stream 50 comprises amounts of sulfur, branched hydrocarbons, olefins and aromatics that are substantially lower than amounts typically found in refinery naphtha. In alternative embodiments, hydrocarbon stream 50 comprises $C_{12}$–$C_{25}$ hydrocarbons. Such $C_{12}$–$C_{25}$ hydrocarbons are typically referred to as Fischer-Tropsch diesel. Heavy distillate 57 comprises hydrocarbons having primarily more than 25 carbons ($C_{26+}$). Methods of fractionation are well known in the art, and the feed to fractionator 15 can be fractionated by any suitable fractionation method, such as atmospheric distillation, vacuum distillation, and short-path distillation. The short-path distillation can comprise molecular distillation, wiped thin film evaporation, or falling-film evaporation. In preferred embodiments, hydrocarbon stream 50 comprises a boiling range with an initial boiling point of about 70° F. (21° C.) and a final boiling point of about 375° F. (191° C.), said boiling point range typically comprising primarily $C_5$–$C_{10}$ linear hydrocarbons with some amounts of $C_4$ and $C_{11}$ linear hydrocarbons being present as well.

At least a portion of hydrocarbon stream 50 is fed to aromatization zone 20 to dehydrocyclize at least a portion of the hydrocarbons in hydrocarbon stream 50 to form aromatization hydrocarbon effluent 55. Dehydrocyclization is defined as the chemical reaction wherein an aromatic compound is formed from an acyclic chemical species accompanied with removal of hydrogen from the species. Dehydrocyclization is at least partially selective for the dehydrocyclization of $C_{7+}$ hydrocarbons in hydrocarbon stream 50. Aromatization hydrocarbon effluent 55 has an octane rating higher than hydrocarbon stream 50. Aromatization zone 20 can comprise any suitable reactor configuration for dehydrocyclization.

Dehydrocyclization in aromatization zone 20 involves passing hydrocarbon stream 50 (or at least a portion thereof) over a dehydrocyclization catalyst in the presence of hydrogen so as to convert at least a portion of the acyclic hydrocarbons in hydrocarbon stream 50 to cyclic, unsaturated hydrocarbons. Preferably, at least a portion of the cyclic, unsaturated hydrocarbons are aromatic hydrocarbons. Aromatization zone 20 can also produce hydrogen, which is preferably fed to isomerization zone 25. The dehydrocyclization catalyst comprises a molecular sieve material, such as natural or synthetic zeolites, synthetic molecular sieves, and clays. The dehydrocyclization catalyst preferably comprises a zeolitic material. Zeolites have a crystalline framework characterized by cages and channels of specific dimensions, which serve as primary reaction sites. Thus, zeolites serve as molecular sieves and are shape-selective. The zeolitic material can include zeolite Y, beta, SSZ-25, SSZ-26, SSZ-33, VPI-5, MCM-22, MCM-41, MCM-36, SAPO-8, SAPO-5, MAPO-36, SAPO-40, SAPO-41, MAPSO-46, CoAPO-50, EMC-2, gmelinite, omega zeolite, offretite, ZSM-18, ZSM-12 or any combination thereof. Other suitable zeolitic materials, which can be used in the dehydrocyclization catalyst, include ZSM-5, ZSM-11, ZSM-12, ZSM-21, ZSM-22, ZSM-23, ZSM-35, ZSM-38, ZSM-48, ZSM-57, SSZ-23, SSZ-25, SSZ-32, SAPO-11, SAPO-31, SAPO-41, MAPO-11, MAPO-31, or any combination thereof.

The dehydrocyclization catalyst further comprises at least one catalytic metal. The catalytic metal comprises at least one metal selected from the Group 6, 8, 9, 10 or 13 metals. Preferably, the catalytic metal comprises palladium, platinum, rhodium, molybdenum, tungsten, gallium, or any combinations thereof. Alternatively, the catalytic metal may comprise an oxide or an oxycarbide of these metals. Most preferably, the metal is platinum. Preferably, the catalytic metal is dispersed throughout the catalyst support. In alternative embodiments, the dehydrocyclization catalyst does not comprise a catalytic metal.

The dehydrocyclization catalyst may further comprise at least one promoter. The promoter comprises any promoters suitable for promoting a catalytic reaction. Preferably, the promoter comprises tin, indium, sulfur, phosphorous, silicon, boron, zinc, gallium, titanium, zirconium, molybdenum, lanthanum, cesium, magnesium, thorium, nickel, any oxides thereof, or any combination thereof. In alternative embodiments, the dehydrocyclization catalyst does not comprise a promoter.

Conditions for dehydrocyclization in aromatization step 20 comprise a gas hourly space velocity between about 1 and about 5 $hr^{-1}$, temperatures between about 200° C. and about 600° C., and pressures between about 80 kPa and about 5,000 kPa. Conditions further comprise a hydrogen to hydrocarbon molar ratio from about 0.1 to about 10, preferably about 3.33.

In an alternative embodiment (not illustrated), hydrogen gas is produced in aromatization step 20. In such an alternative embodiment, the hydrogen gas is fed to isomerization step 25.

At least a portion of aromatization hydrocarbon effluent 55 is fed to isomerization zone 25 to convert some of the acyclic hydrocarbons, in the presence of hydrogen, to isomers of the acyclic hydrocarbons in aromatization hydrocarbon effluent 55. Aromatization hydrocarbon effluent 55 can be isomerized for various purposes, preferably to increase the degree of branching of the hydrocarbons in hydrocarbon stream 50, which increases the octane rating of aromatization hydrocarbon effluent 55.

Isomerization in isomerization zone 25 involves passing aromatization hydrocarbon effluent 55 and hydrogen over a hydroisomerization catalyst under conversion promoting conditions so as to convert at least a portion of the acyclic hydrocarbons in the feed to branched hydrocarbons. The hydroisomerization catalyst in zone 25 is preferably more acidic than the dehydrocyclization catalyst in zone 20. Isomerization is at least partially selective for isomerization of at least a portion of the $C_6$-hydrocarbons in aromatization hydrocarbon effluent 55. Isomerization in isomerization zone 25 results in generating isomerization hydrocarbon effluent 60, which exits isomerization zone 25. Preferably, isomerization hydrocarbon effluent 60 comprises mostly $C_5$–$C_{11}$ hydrocarbons, with the $C_5$–$C_6$ hydrocarbons mostly derived from the aromatization reaction in zone 20 and the $C_7$–$C_{11}$ hydrocarbons mostly derived from the isomerization reaction in zone 25. More preferably, isomerization hydrocarbon effluent 60 comprises branched hydrocarbons; paraffinic hydrocarbons; olefins; and/or substituted $C_6$–$C_8$ aromatic hydrocarbons. Most preferably, isomerization hydrocarbon effluent 60 comprises at least some $C_6$–$C_{10}$ aromatic hydrocarbons. Isomerization hydrocarbon effluent 60 has a higher octane rating than the hydrocarbon feed (i.e., a portion or all of aromatization hydrocarbon effluent 55) to isomerization zone 25.

The hydroisomerization catalyst in zone 25 comprises a shape-selective catalyst or a solid phosphoric acid-type catalyst. Preferably, the hydroisomerization catalyst comprises a shape-selective catalyst. The shape-selective catalyst comprises a material having a low-sodium, high-acidity aluminosilicate zeolite. Low-sodium, high-acidity aluminosilicate zeolites are well known in the art, and the shape-selective catalyst of the present invention can include any low-sodium, high-acidity aluminosilicate zeolite suitable for isomerizing a hydrocarbon stream according to the present invention. Preferably, the shape-selective catalyst is selected from among MCM-22, L-zeolite, K-form L-zeolite, Y-zeolite, HY, ZSM-5, ZSM-11 and HZSM-5. More preferably, the shape-selective catalyst is selected from among MCM-22, L-zeolite, K-form L-zeolite, ZSM-5, and ZSM-11. For example, a ZSM-5 zeolite has an average pore size of about 0.55 nanometers (nm); a MCM-22 zeolite has an average pore size of about 0.70 nanometers (um); and a Y-zeolite has an average pore size of about 0.76 nanometers (nm). Solid phosphoric-type catalysts are well known in the art, and the hydroisomerization catalyst of the present invention can include any solid phosphoric acid-type catalyst suitable for isomerizing a hydrocarbon stream according to the present invention. Preferably, the solid phosphoric-type catalyst comprises a material having SAPO (-11; -31; -34; -41), MAPO (-11; -31), CoAPO, or any combination thereof.

The hydroisomerization catalyst comprises catalytic metal. The catalytic metal comprises at least one metal selected from Groups 8, 9 or 10. Preferably, the catalytic metal comprises palladium, platinum, rhodium, molybdenum, chromium, or combinations thereof. Most preferably, the metal is platinum. Preferably, the catalytic metal is dispersed throughout the catalyst support. In alternative embodiments, the hydroisomerization catalyst does not comprise catalytic metal.

The hydroisomerization catalyst also comprises promoters. The promoters can comprise any promoters suitable for promoting a catalytic reaction. Preferably, the promoters comprise tin, indium, sulfur, phosphorous, silicon, boron, zinc, gallium, titanium, zirconium, molybdenum, lanthanum, cesium, magnesium, thorium, nickel, any oxides thereof, or any combination thereof. In alternative embodiments, the hydroisomerization catalyst does not comprise promoters.

Conditions for isomerizing in isomerization zone 25 comprise a gas hourly space velocity between about 1 and about 3 $hr^{-1}$, temperatures between about 200° C. and about 450° C., and pressures between about 350 psig (2,500 kPa) and about 450 psig (3,200 kPa). Conditions further comprise a hydrogen to hydrocarbon molar ratio from about 0.1 to about 10, preferably about 2.

It is to be understood that aromatization in zone 20 and isomerization in zone 25 improve the octane rating of hydrocarbon stream 50, with the effluent 55 and 60 of each zone 20 and 25, respectively, having a higher octane rating over its feed 50 and 55, respectively.

At least a portion of isomerization hydrocarbon effluent 60 may comprise unconverted hydrocarbons, which comprise normal paraffins. Therefore, at least a portion of isomerization hydrocarbon effluent 60 can be fed to fractionator 27 where it is separated into a cyclized, isomerized hydrocarbon product 65 and an unconverted hydrocarbon stream 70. Unconverted hydrocarbon stream 70 can be recycled to aromatization zone 20 (as shown) and/or isomerization zone 25 (shown in dotted line), preferably recycled to aromatization zone 20. Methods of fractionation are well known in the art, and the feed to hydrocarbon fractionator 27 can be fractionated by any suitable fractionation method, such as atmospheric distillation, vacuum distillation, and short-path distillation. In alternative embodiments, isomerization hydrocarbon effluent 60 is not fed to hydrocarbon fractionator 27. Each of isomerization hydrocarbon effluent 60 and cyclized, isomerized hydrocarbon product 65, both streams comprising aromatic hydrocarbons and isomerized hydrocarbons, can be used as components in gasoline and gasoline blending stock.

Further alternative embodiments include separating at least one fraction or component from aromatization hydrocarbon effluent 55 and/or isomerization hydrocarbon effluent 60. Any component can be separated from such streams 55 and/or 60.

Figure 2:
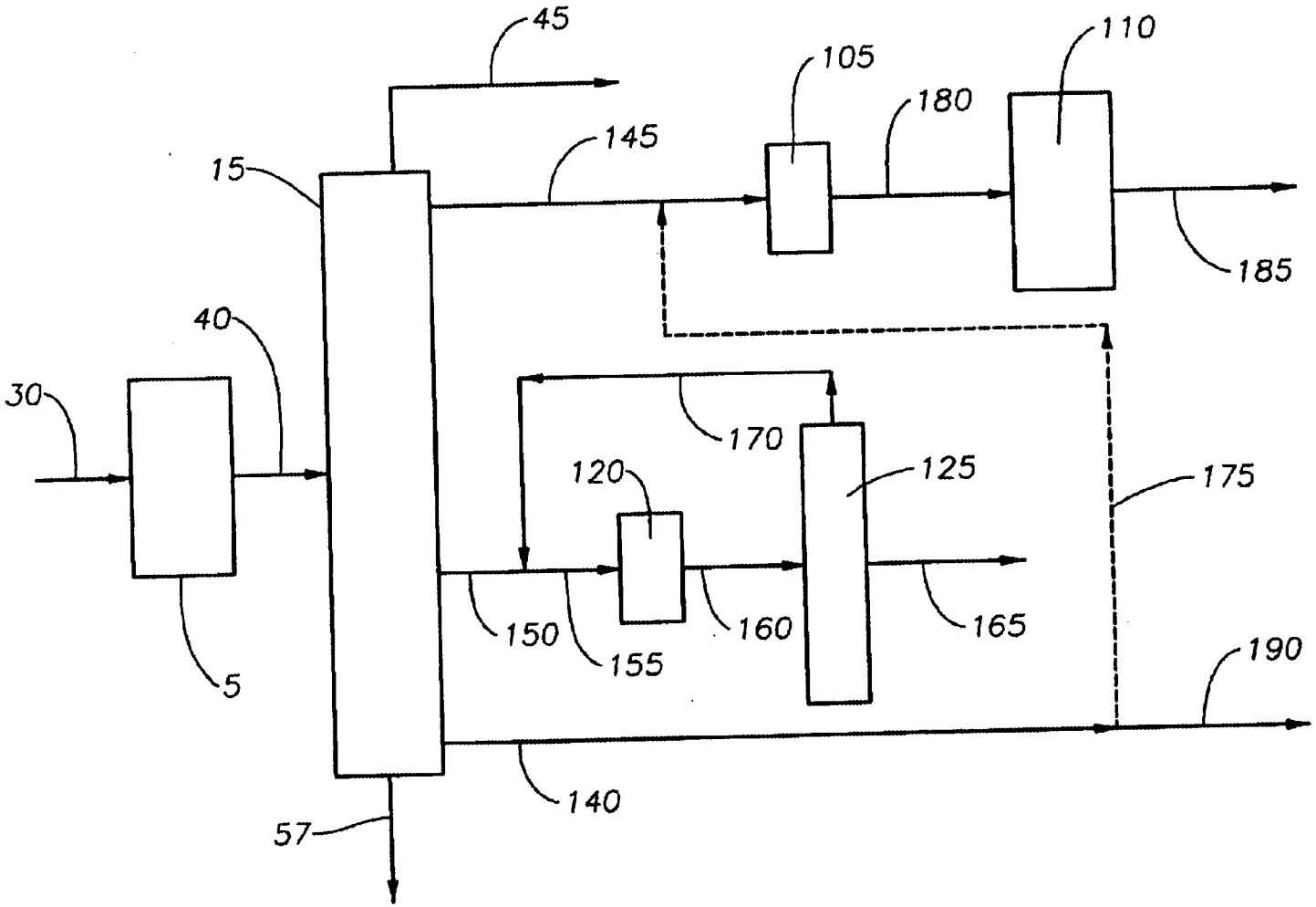
FIG. 2 illustrates a process for producing BTX compounds and olefins comprising a hydrocarbon synthesis reactor, a fractionator, an aromatization zone, a hydrotreater, a steam cracker, and an aromatic fractionator.

FIG. 2 illustrates a further embodiment of the invention comprising a process for upgrading hydrocarbons by increasing its octane rating wherein the process comprises hydrocarbon synthesis reactor 5, fractionator 15, a hydrotreater 105, a steam cracker 110, an aromatization process 120, and an aromatic fractionator 125. In regards to the processing of syngas feed 30, it is to be understood that the embodiment illustrated in FIG. 2 comprises all of the elements of the above-discussed embodiments in FIG. 1 and alternative embodiments thereof up to the fractionation step. In fractionator 15, fractionator feedstream 40 is separated into gas exhaust 45, a light distillate 145, an intermediate distillate 150, a heavy distillate 140, and a heavy distillate 57. Light distillate 145 mainly comprises $C_4$–$C_5$ hydrocarbons, heavy distillate 140 mainly comprises $C_9$–$C^{11}$ hydrocarbons, and intermediate distillate 150 mainly comprises $C_6$–$C_8$ hydrocarbons. Preferably, light distillate 145, intermediate distillate 150, and heavy distillate 140 comprise mainly acyclic hydrocarbons. In a preferable embodiment, distillates 145, 150 and 140 each comprise Fischer-Tropsch naphtha. It is to be understood that the present invention is not limited to such distillates, but can comprise more or less distillates. For instance, although not illustrated in FIG. 2, a diesel distillate can be separated as well. It is to be further understood that each of light distillate 145, intermediate distillate 150, and heavy distillate 140 comprise a substantially lower amount of sulfur than conventional refinery middle distillates. Light distillate 145, intermediate distillate 150, and heavy distillate 140 preferably comprise less than 50 ppm S, more preferably less than 20 ppm S, and still more preferably less than 10 ppm S.

As illustrated in FIG. 2, intermediate distillate 150 is fed to aromatization process 120. Aromatization process 120 can be conducted in one or more reactors. Aromatization process 120 can comprise two different cyclization steps. Some embodiments employ specific cyclization promoting conditions A and B in aromatization process 120 for pressure, temperature, and the preferred catalyst as listed in Table 1.

TABLE 1

Specific aromatization conditions for aromatization process 120.

| | Conditions A | Conditions B |
|---|---|---|
| Pressure (kPa) | ca. 1200 | 400–5000 |
| Temperature (° C.) | 450–510 | 490–540 |
| Catalyst | Potassium on modified L-zeolite | Platinum with optionally rhenium on alumina |

In aromatization process 120, intermediate distillate 150 is passed over catalysts under sufficient conditions to produce a yield of benzene-toluene-xylenes-ethyl benzene (BTX) of at least about 70% from the feed. Such conditions are sufficient to produce a BTX product 160 having a benzene content that results from more than 70% conversion of $C_6$ hydrocarbons to benzene; a toluene content that results from more than 70% conversion of $C_7$ hydrocarbons to toluene; and a xylene content that results from more than 70% conversion of $C_8$ hydrocarbons to xylene. For example, reacting in the aromatization zone a feedstream comprising 80% $C_6$ hydrocarbons and 20% $C_7$ hydrocarbons with a paraffinic content greater than 90% and an isoparaffirin-paraffin ratio of 1:1 yields an aromatization effluent comprising more than 60% benzene; about 14% toluene, about 7% hydrogen and about 10% unconverted hydrocarbons. Such sufficient conditions and catalysts are disclosed in U.S. Pat. Nos. 5,609,751; 5,645,812; 5,922,922; and 5,958,217; all of which are incorporated herein by reference in their entirety. Intermediate distillate 150 is passed over such catalysts at such conditions in aromatization process 120 to produce such a yield and a product with such a composition. Typically, conventional refinery hydrocarbons are fed to an aromatization process having such catalysts and conditions. However, the intermediate distillate 150 of the present invention (preferably a portion of Fischer-Tropsch naphtha comprising mainly $C_6$–$C_8$) is substantially different from a typical refinery middle distillate such as a petroleum refinery naphtha. For instance, intermediate distillate 150 comprises amounts of sulfur, branched hydrocarbons, olefins and aromatics that are substantially lower than amounts typically found in refinery naphtha. Intermediate distillate 150 preferably comprises less than 0.1 percent by weight of sulfur-containing hydrocarbons; less than 1 percent by weight of aromatics; and less than 10 percent by weight of olefins.

In one embodiment, the first stage of aromatization process 120 has an aromatization catalyst comprising a micro porous molecular sieve support and components from two catalytic metal groups. Preferably, the catalyst is an acidic, shape selective catalyst. Molecular sieves are well known in the art, and the molecular sieves of the present invention can comprise any molecular sieve suitable for producing BTX product 160. For instance, examples of molecular sieves that can be used include ZSM-5, ZSM-11, ZSM-12, ZSM-21, ZSM-22, ZSM-23, ZSM-35, ZSM-38, ZSM-48, ZSM-57, SSZ-23, SSZ-25, SSZ-32, SAPO-11, SAPO-31, SAPO-41, MAPO-11, and MAPO-31. In some embodiments, the molecular sieve material has an average pore size between about 0.5 nanometers (nm) and about 0.8 nm. For example, a ZSM-5 zeolite has an average pore size of about 0.55 nm; a MCM-22 zeolite has an average pore size of about 0.70 nanometer (nm); and a Y-zeolite has an average pore size of about 0.76 nanometer (nm). Preferably, the sieves are bound with any suitable inorganic oxide binder. One of the catalytic metal groups is a platinum metal group. The catalyst comprises at least one such platinum group metal, preferably iridium and/or palladium (most preferably platinum). The platinum group metals are present in the catalyst between about 0.1 wt. % and about 5.0 wt. %, more preferably between about 0.3 wt. % and about 2.5 wt. %. The other catalytic metal group comprises gallium, zinc, indium, iron, tin, and/or boron (preferably gallium). Such metals are present in the catalyst between about 0.1 wt. % and about 10 wt. %, preferably between about 1 wt. % and about 5 wt. %.

In the second stage of such an embodiment, the catalyst is a non-acidic aromatization catalyst that increases the aromatics yield. The catalyst preferably comprises an inorganic oxide support with an inorganic oxide binder. Inorganic oxide supports are well known, and any inorganic oxide support suitable for producing BTX product 160 with the yield of the present invention can be used. For instance, suitable supports include beta-zeolite, ZSM-5, silicalite, and L-zeolite, preferably L-zeolite. The catalyst also comprises any catalytic metal, preferably a platinum group metal (most preferably platinum). Promoter metals can also be used. Preferable promoters include at least one of rhenium and tin.

Aromatization process 120 is carried out at suitable aromatization conditions. Preferably, conditions include a pressure from about −10 psig (about 30 kPa) to about 800 psig (about 5,600 kPa), more preferably from about 50 psig (about 440 kPa) to about 400 psig (about 2,900 kPa); still more preferably from about 100 psig (about 800 kPa) to about 200 psig (about 1,500 kPa); most preferably about 160–175 psig (about 1,000–1,200 kPa); a liquid hourly space velocity from about 1 $hr^{-1}$ to about 10 $hr^{-1}$, more preferably from about 0.5 $hr^{-1}$ to about $hr^{-1}$, and most preferably 1 $hr^{-1}$ to 4 $hr^{-1}$; a temperature from about 400° C. to about 550° C., more preferably from about 450° C. to about 510° C.; and a hydrogen to hydrocarbon molar ratio of from about 1 to about 20, more preferably from about 2 to about 10. Preferably, the conditions are sufficiently adjusted to produce a desired BTX yield as noted above.

In alternative embodiments, both stages comprise acidic catalysts. In such alternative embodiments, the first stage comprises isomerizing intermediate distillate 150 in the presence of a first acidic catalyst and hydrogen to produce a partially-branched, isomerized alkene. The second stage comprises alkylating such alkene with a non-oxygen-containing aromatic hydrocarbon in the presence of a second acidic catalyst and hydrogen to produce BTX product 160. The catalyst of the first stage can be solid or liquid. In addition, the catalyst is a molecular sieve comprising at least one metal oxide. More preferably, the catalyst is a molecular sieve having a one-dimensional, micro porous system such as MAPO-11, SAPO-11, SSZ-32, ZSM-23, MAPO-39, SAPO-39, ZSM-22, SSZ-20, ZSM-35, SUZ4, NU-23, NU87, natural ferrierites, and synthetic ferrierites. The isomerization can be carried out in a batch or continuous mode at conditions sufficient for isomerization. Process conditions include temperatures between about 50° C. and about 250° C. In a continuous process having a fixed bed, the space rates are between about 0.1 $hr^{-1}$ and about 10 $hr^{-1}$.

In such alternative embodiments, the second stage catalyst can be selected from among natural zeolites, synthetic zeolites, synthetic molecular sieves, and clays. Suitable examples of such zeolites include zeolite Y, beta, SSZ-25, SSZ-26, SSZ-33, VPI-5, MCM-41, MCM-36, SAPO-8, SAPO-5, MAPO-36, SAPO-40, SAPO-41, MAPSO-46, CoAPO-50, EMC-2, gmelinite, omega zeolite, offretite, ZSM-18, and ZSM-12. Suitable alkylation conditions for the second stage include an aromatic to olefin molar ratio of from 1:15 to 25:1, temperatures between about 100° C. to about 250° C., and a gas hourly space velocity between 0.01 $hr^{-1}$ to 10 $hr^{-1}$. It is to be understood that the process can be batch or continuous.

Further alternative embodiments include a first stage having a non-acidic reforming catalyst and a second stage including an acidic isomerization catalyst. In the first stage, intermediate distillate 150 is passed over the reforming catalysts at elevated temperatures in the presence of hydrogen to produce a reformate stream containing ethylbenzene and xylenes. The catalyst comprises a non-acidic zeolitic support, preferably comprising a micro porous support such as any of the ZSM series. The more preferable zeolites are ZSM-5, ZSM-11, ZSM-12, silicalite and mixtures thereof (most preferably ZSM-5). Preferable reformation conditions include a temperature of from about 400° C. to about 600° C., more preferably 430° C. to 550° C.; a pressure of from about 1 atm (about 100 kPa) to about 500 psig (about 3,400 kPa), more preferably 75 psig (about 620 kPa) to about 100 psig (about 800 kPa); a LSHV of from 0.3 $hr^{-1}$ to 5 $hr^{-1}$, and a hydrogen to hydrocarbon molar ratio of from 1:1 to 10:1, more preferably 2:1 to 5:1.

In such further alternative embodiments, at least a portion of the reformate is reacted at elevated temperatures over the isomerization catalyst to produce BTX product 160 in the presence of hydrogen. The isomerization catalyst comprises a modifier on a micro porous zeolitic support. The modifiers include magnesium, calcium, barium, and/or phosphorous. Preferably, the second stage occurs in the presence of hydrogen. Such supports are acidic and preferably comprise a micro porous support such as any of the. ZSM series. The more preferable zeolites are ZSM-5, ZSM-11, ZSM-12, silicalite and mixtures thereof (most preferably ZSM-5). Second stage conditions include a temperature that is the same as that at the exit of the first stage; a pressure of from about 1 atm (about 100 kPa) to about 500 psig (about 3,550 kPa), preferably about 75 psig (about 620 kPa) to about 100 psig (about 800 kPa); a gas hourly space velocity of from 5 $hr^{-1}$ to 10 $hr^{-1}$ based on the zeolite; and a hydrogen to hydrocarbon molar ratio of 1:1 to 10:1, more preferably 2:1 to 5:1.

In all embodiments of FIG. 2, at least a portion of BTX product 160 may be unconverted. Therefore, BTX product 160 can be fed to aromatic fractionator 125 where it is separated into converted BTX stream 165 and unconverted BTX stream 170. Converted BTX stream 165 comprises mainly benzene, toluene, xylenes, and ethyl benzene, and optionally hydrogen. Unconverted BTX stream 170 comprises mainly normal paraffins. Preferably, at least a portion of unconverted BTX stream 170 is recycled to aromatization process 120. Methods of fractionation are well known in the art, and BTX product 160 can be fractionated in aromatic fractionator 125 by any suitable fractionation method, such as atmospheric distillation, vacuum distillation, and short-path distillation. In alternative embodiments, BTX product 160 is not fed to aromatic fractionator 125. Converted BTX stream 165 and BTX product 160 can be used as components in gasoline and gasoline blending stock. Converted BTX stream 165 and BTX product 160 can serve as octane boosters in synthetic naphtha. Converted BTX stream 165 and BTX product 160 can be also used as solvents or chemical feedstocks.

If it is desirable to have only small amounts or almost no benzene present in converted BTX stream 165 and BTX product 160, especially when these streams may be used as octane boosters in gasoline formulation, it is possible to use intermediate distillate 150, which comprises mainly $C_7$–$C_8$ so as to form mainly toluene and xylenes in aromatization process 120. In order to achieve an intermediate distillate 150 that is substantially free of $C_6$ hydrocarbons, fractionator 15 can be operated so that the $C_6$ hydrocarbons exit fractionator 15 in light distillate 145 so that light distillate 145 includes $C_4$–$C_6$ hydrocarbons, or alternatively, a separate fraction comprising essentially $C_6$ hydrocarbons (not illustrated) can exit fractionator 15 and can be used as a solvent or chemical feedstock.

Substantially all of light distillate 145 can be fed to hydrotreater 105. In addition, at least a portion 175 of heavy distillate 140 can be sent to hydrotreater 105. Portion 175 can be combined with light distillate 145 (as shown) before entering hydrotreater 105 or can be fed separately to hydrotreater 105.

The hydrotreatment in hydrotreater 105 saturates substantially all of the olefins or substantially all of the olefins present in light distillate 145 and portion 175 of heavy distillate 140. The hydrotreatment may also substantially convert all of the oxygenates to paraffins or may allow some small amount of the oxygenates to remain unconverted. The hydrotreatment is effective to generate a suitable steam cracker feedstream 180. In some embodiments, steam cracker feedstream 180 has an olefin content less than about 150 ppm. In addition, steam cracker feedstream 180 may have an oxygenate content less than about 150 ppm.

It is preferred that the feed to steam cracker 110 be hydrotreated before it enters steam cracker 110 so as to provide a hydrocarbon feed to steam cracker 110 comprising only small amounts of olefins and oxygenates, such as an olefin content not exceeding 0.5 wt %, more preferably less than 0.1 wt %, still more preferably less than 150 ppm, and an oxygenate content lower than about 200 ppm, preferably lower than about 150 ppm, and alternatively, less than about 50 ppm. Even though the hydrotreatment step is illustrated as being performed in hydrotreater 105 on the feed to steam cracker 110 downstream of fractionator 15, it is also envisioned that a hydrotreatment step can also be performed prior to fractionation in fractionator 15 (such as represented by hydrotreater 10 in FIG. 1) instead of or in addition to a downstream hydrotreatment step as represented by hydrotreater 105 in FIG. 2.

Steam cracker feedstream 180 preferably has an olefin content not exceeding 0.5 wt %, more preferably less than 0.1 wt %, still more preferably less than 150 ppm. Steam cracker feedstream 180 preferably has an oxygenate content lower than about 200 ppm, preferably lower than about 150 ppm, and alternatively, less than about 50 ppm. Steam cracker feed stream 180 is fed to steam cracker 110 under cracking promoting conditions so as to convert some of the hydrocarbonaceous components of steam cracker feed stream 180 to olefins.

The use of steam crackers to crack hydrocarbons to yield olefins is well known in the art, and steam cracker 110 can comprise any known type of steam cracking equipment and operating conditions suitable for obtaining a desirable olefin yield. Preferably, steam cracker 110 comprises a furnace having tubes for circulating steam and hydrocarbon feed 180. The inlet temperature of steam (not shown) and steam cracker feed stream 180 feeding into steam cracker 110 is preferably from about 825° C. to about 925° C. The residence time in steam cracker 110 is preferably from about 50 milliseconds (ms) to about 300 ms. In addition, the exit temperature from steam cracker 110 of steam cracker product 185 is preferably from about 850° C. to about 950° C. The present invention is not limited to these temperatures and residence times but instead may have higher or lower values depending on the desired olefin yield, the type of steam cracking equipment used, the size of the steam cracking equipment used, and the like.

The production of steam from water is well known in the art and typically employs a steam generator (not illustrated), which includes any known process and equipment suitable for production of a desired steam from water in the present invention.

The molar ratio of steam to steam cracker feed steam 180 fed into steam cracker 110 is from about 3:7 to about 7:3, preferably from about 3:7 to about 1:1, and more preferably about 1:2 (or 0.5).

The preferred olefins produced in steam cracker 110 are ethylene and propylene, and more preferably ethylene. The olefin, ethylene and propylene yields can be at least 40 weight percent (wt %), 20 wt %, and 5 wt %, respectively, of steam cracker product 185. The preferable olefin yield is between about 40 wt % and about 70 wt % of steam cracker product 185 and more preferably between about 45 wt % and about 60 wt % of steam cracker product 185. The preferable ethylene yield is between about 20 wt % and about 45 wt % of steam cracker product 185 and more preferably between about 25 wt % and about 40 wt % weight percent of steam cracker product 185. In addition, the preferable yield of propylene is between about 5 wt % and about 30 wt % of steam cracker product 185 and more preferably between about 10 wt % and about 25 wt % weight percent of steam cracker product 185. The ratio of propylene yield to ethylene yield is preferably between about 0.3 and about 0.7. It will be understood that adjusting the residence time, inlet temperatures and ratio of steam to stream cracker feed stream 180 can adjust the yield of olefin products produced and also adjust the total olefin yield. Therefore, the present invention is not limited to a specific olefin and olefin product yield but includes any desired yield.

Portion 190 of heavy distillate 140 comprising mainly $C_9$–$C_{11}$ hydrocarbons can be blended with another fraction (not illustrated) from fractionator 15, which comprises hydrocarbons in the diesel boiling range. It can be employed as a solvent.

It is to be understood that the present invention is not limited to the process steps as described above. For instance, the process can be carried out without a hydrotreatment step or the hydrotreatment step can be carried out at a different point in the process (such a after fractionation). It is to be further understood that the present invention can be carried out without hydrocarbon synthesis reactor 5, optional hydrotreater 10, and/or fractionator 15. For instance, the process can begin with a hydrocarbon stream 50 or intermediate distillate 150 that is fed to isomerization zone 25 and/or aromatization zone 20 or aromatization process 120, respectively.

Figure 3:
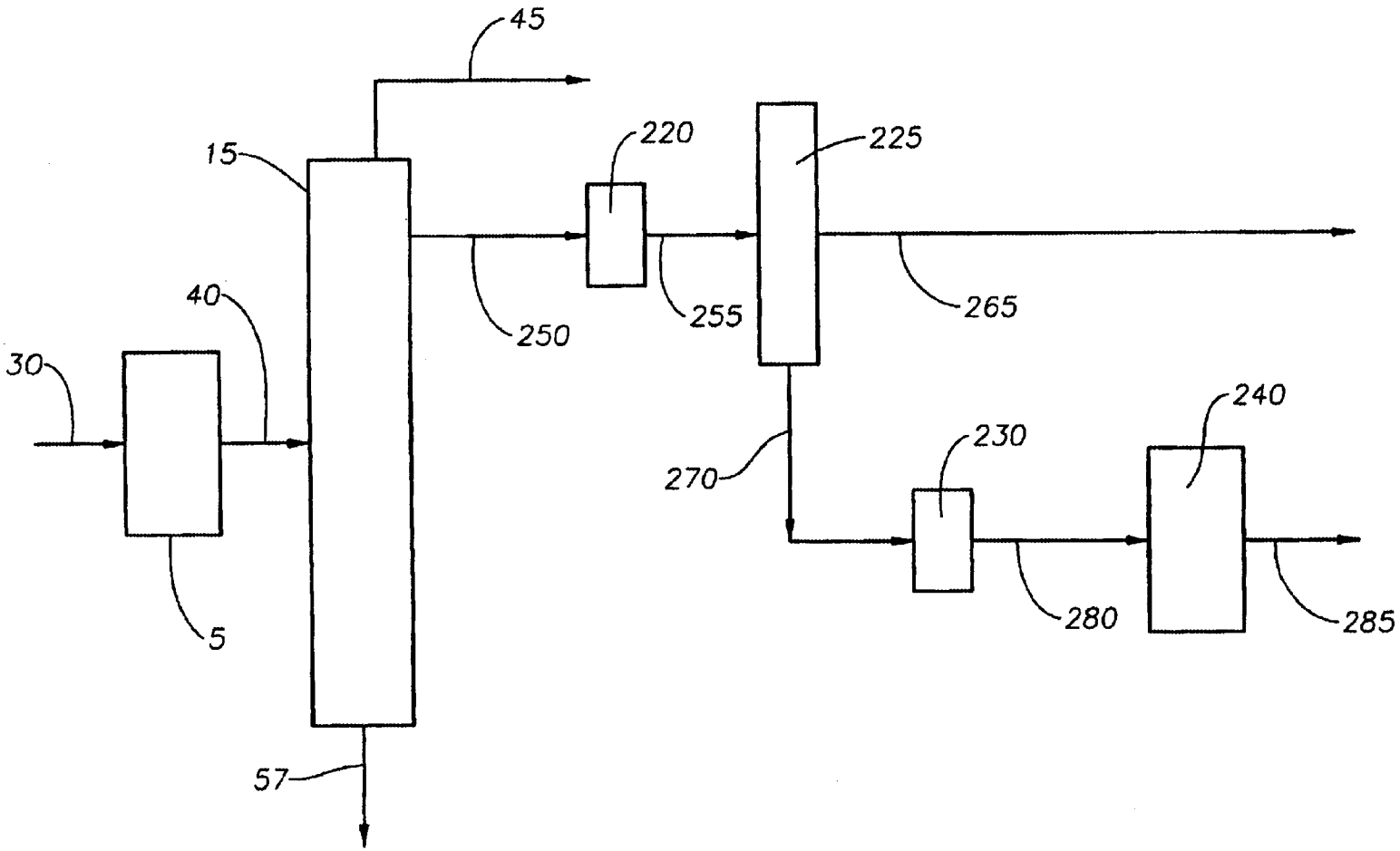
FIG. 3 illustrates a process for producing BTX compounds, solvents and olefins comprising a hydrocarbon synthesis reactor, a fractionator, an aromatization zone, an aromatic fractionator, a hydrotreater, and a steam cracker.

FIG. 3 illustrates a further embodiment of the invention comprising a process for producing BTX products and olefins, wherein the process comprises hydrocarbon synthesis reactor 5, fractionator 15, aromatization zone 220, aromatic fractionator 225, hydrotreater 230, and steam cracker 240. In regards to the processing of syngas feed 30, it is to be understood that the embodiment illustrated in FIG. 3 comprises all of the elements of the above-discussed embodiments in FIG. 1 and alternative embodiments thereof up to the fractionation step. In fractionator 15, fractionator feedstream 40 is separated into a gas exhaust 45, a naphtha distillate 250, and a heavy distillate 57. Naphtha distillate 250 mainly comprises $C_4$–$C_9$ hydrocarbons, while gas exhaust 45 mainly comprises $C_5$-hydrocarbons. Preferably, naphtha distillate 250 comprises mainly acyclic hydrocarbons.

It is to be understood that the present invention is not limited to such distillates but can comprise more or less distillates. For instance, although not illustrated in FIG. 3, a diesel distillate can be separated as well. It is to be further understood that naphtha distillate 250 comprises a substantially lower amount of sulfur than conventional refinery middle distillates. Naphtha distillate 250 preferably comprises less than 20 ppm S, more preferably less than 10 ppm S, still more preferably less than 5 ppm S, yet still more preferably less than 1 ppm S.

As illustrated in FIG. 3, naphtha distillate 250 is fed to aromatization process 220. Aromatization process 220 is similar to either aromatization process 20 of FIG. 1 or aromatization process 120 of FIG. 2, both described earlier. Naphtha distillate 250 is passed over at least one catalyst under sufficient conditions to convert some of the acyclic hydrocarbons to aromatic hydrocarbons so as to generate aromatization effluent 255.

At least a portion of aromatization effluent 225 can be fed to aromatic fractionator 225 where it is separated into a BTX product 265 and an unconverted hydrocarbon stream 270. Methods of fractionation are well known in the art, and the feed to aromatic fractionator 225 can be fractionated by any suitable fractionation method, such as atmospheric distillation. In alternative embodiments, a portion of aromatization effluent 255 is not fed to aromatic fractionator 225, and this portion can be used as component in gasoline and gasoline blending stock.

Unconverted hydrocarbon stream 270 can be recycled to aromatization process 220 (not shown in FIG. 3, but illustrated in FIGS. 1 and 2). Preferably, a portion or essentially all of unconverted hydrocarbon stream 270 is fed to hydrotreater 230 (as shown). Hydrotreatment of stream 270 is similar to that described for hydrotreatment in hydrotreater 105 in FIG. 2. It is preferred that the feed to steam cracker 240 be hydrotreated before it enters steam cracker 240 so as to provide a hydrocarbon feed 280 to steam cracker 240 comprising only small amounts of olefins and oxygenates (preferably less than 150 ppm). The hydrotreatment in hydrotreater 230 saturates substantially all of the olefins or substantially all of the olefins present in unconverted hydrocarbon stream 270. The hydrotreatment may also substantially convert all of the oxygenates to paraffins or may allow some amount of the oxygenates to remain unconverted. The hydrotreatment is effective to generate a suitable steam cracker feedstream 280. Steam cracker feedstream 280 has similar olefins and oxygenates content specifications as previously described for steam cracker feedstream 180 in FIG. 2.

The use of steam crackers to crack hydrocarbons to yield olefins is well known in the art, and steam cracker 240 can comprise any known type of steam cracking equipment and operating conditions suitable for obtaining a desirable olefin yield. Suitable cracking conditions to form a steam cracker product 285 are the same as described for steam cracker 110 of FIG. 2. Compositions of steam cracker product 285 are also similar to that of steam cracker product 185 of FIG. 2.

Although the present invention and its advantages have been described in detail, it should be understood that various changes, substitutions and alterations may be made herein without departing from the spirit and scope of the invention as defined by the appended claims.

What is claimed is:

1. A method for improving the octane number of a synthetic naphtha stream, comprising:

(A) providing a hydrocarbon feedstream comprising primarily $C_4$–$C_8$ acyclic hydrocarbons, wherein the hydrocarbon feedstream has an octane number and is derived from a hydrocarbon synthesis process;

(B) reacting the hydrocarbon feedstream under aromatization promoting conditions so as to convert at least some of the acyclic hydrocarbons to aromatic hydrocarbons and generate a cyclized hydrocarbon stream, wherein the cyclized hydrocarbon stream includes said aromatic hydrocarbons and unconverted acyclic hydrocarbons; and (C) reacting the cyclized hydrocarbon stream under isomerization promoting conditions so as to convert at least some of the unconverted acyclic hydrocarbons to branched hydrocarbons and generate a cyclized, isomerized hydrocarbon stream, wherein the cyclized, isomerized hydrocarbon stream includes aromatic hydrocarbons and branched hydrocarbons, and has an octane number greater than the octane number of the hydrocarbon feedstream.

2. The method of claim 1, wherein the hydrocarbon feedstream is a Fischer-Tropsch naphtha stream.

3. The method of claim 1, wherein the cyclized, isomerized hydrocarbon stream further comprises paraffinic hydrocarbons; olefins; substituted $C_6$–$C_8$ aromatic hydrocarbons; or combinations thereof.

4. The method of claim 1, wherein steps (B) and (C) occur in more than one reactor.

5. The method of claim 1, wherein steps (B) and (C) occur in the same reactor.

6. The method of claim 5, wherein steps (B) and (C) occur in sequence.

7. The method of claim 1, wherein step (B) comprises passing hydrogen and at least a portion of the hydrocarbon feedstream over a shape-selective catalyst.

8. The method of claim 7, wherein step (B) further comprises a hydrogen to hydrocarbon molar ratio from about 0.1 to about 10.

9. The method of claim 1, wherein the hydrocarbon feedstream comprises more than 80% paraffins.

10. The method of claim 1, wherein the branched hydrocarbons comprise isoparaffins.

11. The method of claim 1, wherein step (B) further produces hydrogen.

12. The method of claim 11, wherein the hydrogen is fed to step (C).

13. The method of claim 1, wherein step (C) comprises passing hydrogen and the cyclized hydrocarbon stream over a solid phosphoric catalyst.

14. The method of claim 1, wherein step (C) comprises passing hydrogen and the cyclized stream over a shape-selective catalyst.

15. The method of claim 14, wherein the shape-selective catalyst comprises at least one material selected from the group consisting of MCM-22, L-zeolite, K-form L-zeolite, Y-zeolite, HY, ZSM-5, ZSM-11, HZSM-5.

16. The method of claim 1, wherein step (C) further comprises a hydrogen to hydrocarbon molar ratio of from about 0.1 to about 10.

17. The method of claim 1, further comprising (D) feeding at least a portion of the cyclized, isomerized hydrocarbon stream to a fractionator so as to separate unconverted hydrocarbons from the branched and aromatic hydrocarbons.

18. The method of claim 17, wherein the unconverted hydrocarbons are recycled to at least one of steps (B) and (C).

19. A method for improving the octane number of a synthetic naphtha stream, comprising:

(A) providing a hydrocarbon feedstream comprising primarily $C_4$–$C_8$ acyclic hydrocarbons, wherein the hydrocarbon feedstream has an octane number and is derived from a hydrocarbon synthesis process;

(B) reacting the hydrocarbon feedstream under isomerization promoting conditions so as to convert at least some of the acyclic hydrocarbons to branched acyclic hydrocarbons and generate an isomerized hydrocarbon stream, wherein the isomerized hydrocarbon stream includes branched acyclic hydrocarbons and unconverted acyclic hydrocarbons; and (C) reacting the isomerized hydrocarbon stream under aromatization promoting conditions so as to convert at least some of the unconverted acyclic and isomerized acyclic hydrocarbons to aromatic hydrocarbons and generate a cyclized, isomerized hydrocarbon stream, wherein the cyclized, isomerized hydrocarbon stream includes aromatic hydrocarbons and branched acyclic hydrocarbons, and has an octane number greater than the octane number of the hydrocarbon feedstream.

20. The method of claim 19, wherein the hydrocarbon feedstream is a Fischer-Tropsch naphtha stream.

21. The method of claim 19, wherein the cyclized, isomerized hydrocarbon stream further comprises paraffinic hydrocarbons; olefins; substituted $C_6$–$C_8$ aromatic hydrocarbons; or combinations thereof.

22. The method of claim 19, wherein step (B) comprises passing hydrogen and the hydrocarbon feedstream over a solid phosphoric catalyst.

23. The method of claim 19, wherein step (B) comprises passing hydrogen and the hydrocarbon feedstream over a shape-selective catalyst.

24. The method of claim 23, wherein the shape-selective catalyst comprises at least one material selected from the group consisting of MCM-22, L-zeolite, K-form L-zeolite, Y-zeolite, HY, ZSM-5, ZSM-11, and HZSM-5.

25. The method of claim 19, wherein step (B) further comprises a hydrogen to hydrocarbon molar ratio of from about 0.1 to about 10.

26. The method of claim 19, wherein step (C) comprises passing hydrogen and substantially all of the isomerized hydrocarbon stream over a shape-selective catalyst.

27. The method of claim 26, wherein step (C) further comprises a hydrogen to hydrocarbon molar ratio from about 0.1 to about 10.

28. The method of claim 19, wherein step (C) further produces hydrogen.

29. The method of claim 28, wherein the hydrogen produced in step (C) is fed to step (B).

30. The method of claim 19, further comprising (D) feeding at least a portion of the cyclized, isomerized hydrocarbon stream to a fractionator so as to separate unconverted hydrocarbons from the isomerized, cyclic hydrocarbons.

31. The method of claim 30, wherein the unconverted hydrocarbons are recycled to at least one of steps (B) and (C).

* * * * *